United States Patent [19]

Biermann et al.

[11] 4,142,735

[45] Mar. 6, 1979

[54] SAFETY SKI BINDING

[75] Inventors: Peter Biermann, Warmbronn; Brigitte Sittmann, Stuttgart, both of Fed. Rep. of Germany

[73] Assignee: Vereinigte Baubeschlagfabriken Gretsch & Co. GmbH, Fed. Rep. of Germany

[21] Appl. No.: 696,685

[22] Filed: Jun. 16, 1976

[30] Foreign Application Priority Data

Jun. 16, 1975 [DE] Fed. Rep. of Germany ..... 2526822

[51] Int. Cl.[2] ..... A63C 9/08

[52] U.S. Cl. ..... 280/618; 280/605; 280/622; 280/637

[58] Field of Search ..... 280/637, 613, 618, 611, 280/605, 622

[56] References Cited

U.S. PATENT DOCUMENTS 3,083,028 3/1963 Miller ..... 280/605

3,918,730 11/1975 Schultes ..... 280/605

3,997,188 12/1976 Begey ..... 280/613

FOREIGN PATENT DOCUMENTS 171069 11/1934 Switzerland ..... 280/637

*Primary Examiner*—Joseph F. Peters, Jr.
*Assistant Examiner*—Milton L. Smith
*Attorney, Agent, or Firm*—Craig & Antonelli

[57] ABSTRACT

A safety ski binding which includes a cable interconnecting a ski boot or plate attached to a ski boot with the ski. A restoring spring is provided which forces the cable toward a position holding the ski boot in an in-use skiing position on the ski, while permitting relative movement of the boot and ski and consequent extension of the cable. To prevent serious injuries in the case of full extension of the cable, the cable is disconnected, thereby fully separating the ski and boot. In preferred embodiments, a ski brake is provided to brake the separated ski.

33 Claims, 10 Drawing Figures

SAFETY SKI BINDING

BACKGROUND AND SUMMARY OF THE INVENTION

The invention relates to a safety ski binding, in which the ski boot is held onto the ski by an extensible retraction device, which on exceeding a predetermined releasing force is extended counter to a restoring force, whereby the boot is to a certain extend removed from the ski.

The advantage of the so-called retraction binding is that after extension has taken place, for example, in the case of a fall, the ski boot is automatically drawn to the ski again where it is secured. Thus, after a fall, the time-consuming re-strapping of the ski, as is necessary with conventional safety ski bindings, is consequently unnecesssary. However, it is a disadvantage with the known retraction bindings that the releasing force is substantially maintained throughout the entire extension process and that, due to the constant connection between boot and ski, accidents can still occur despite the given possibility of extension, e.g.; through the ski getting caught somewhere.

The problem of the invention is therefore to provide a safety ski binding of the type defined hereinbefore which has all the advantages of the retraction binding but which effectively prevents injuries of the skier through the constant connection between ski boot and ski.

According to the invention, this problem is solved in that, on reaching the full extension length, the connection between ski boot and ski is broken. In general, the full extension length is not reached on falling so that generally the advantages of the retraction binding, namely more particularly the immediate restoring of the connection between ski boot and ski are fully maintained. However, in the case of an extreme fall the retraction device will become fully extended and, according to the invention, the connection is broken. the skier is now completely free from the ski and consequently cannot be injured through the ski boot remaining secured to the ski.

So that after separation of ski boot and ski the ski movement is stopped, according to a preferred embodiment a ski brake is released when the ski boot separates from the ski. Conventional ski brakes can be used for this purpose; however, it is preferably if the release part which becomes effective on full extension of the retraction device, particularly the retraction cable, releases a ski brake. Thus, the part which brings about separation o the ski boot and ski at full extension is in this case used in two different ways.

If the ski boot is fixed to a sole plate which is connected with the ski via the retraction device, the mounting for the ski boot on the plate is appropriately made detachable in the case of a fully extended retraction device. This construction has the advantage that, after the release, the sole plate can immediately be moved back to the ski making the latter ready for reinsertion of the ski boot.

A first embodiment is constructed in such a way that a plunger which can be extended by a cable fixed to one side of the ski is longitudinally displaceably arranged in a longitudinal groove of the plate, said plunger being prestressed to a normal position in which the plate is held on the ski by a spring, and simultaneously serves as the release member for the mounting. In the same way the plunger can optionally also release a ski brake.

In the area of the end of the longitudinal groove, a movable shoulder, prestressed in the retaining direction by a spring, appropriately projects into said groove and serves to release the mounting and optionally also the ski brake.

The mounting is preferably a holding-down device which can be pivoted about a transverse axis and/or a vertical axis which is arranged on the plate and is held on the ski boot sole in detachable manner by means of the shoulder. On inserting the ski boot, the holding-down device can automatically snap into the shoulder as a result of suitably arranged inclined surfaces.

Another embodiment is based on a safety ski binding where a cable drum, whose cable is fixed to the ski and prestressed in the winding-on direction by a spring, is provided on the plate.

In this connection, the invention provides for the mounting of the ski boot on the plate to be detachable in the case of a fully extended cable. A projection is advantageously provided on the cable drum which, when the cable is fully extended, operates a locking lever prestressed in the locking direction and which releases the mounting. The same shoulder or lever can also release a ski brake.

The mounting is also preferably constructed as a holding-down device which can be provided about a transverse axis and on which engages the locking lever.

A further advantageous embodiment is characterised in that a locking lever is provided which, when operated releases the mounting and which is connected with the ski by a unlocking member in such a way that when the cable line is fully extended the unlocking member is placed under tension and throws the locking lever into its release position. The unlocking member is advantageously a helically wound unlocking cable which has a limited length in the normal position, but which in use can be extended to a multiple of its length. In a further embodiment, a toggle-joint holding-down device is connected with an extensible unlocking member whose other end is fixed to the ski in such a way that, with the cable line fully extended, the unlocking member is placed under tension and the toggle-joint holding-down device is opened.

Finally, the invention can also be used with safety ski bindings in which the ski boot is fixed to a sole plate which is connected with the ski via the retraction device. According to the invention, with such bindings the sole plate is detachable from the ski when the retraction device is fully extended.

According to a first embodiment, the plate can be connected via the retraction device with an intermediate plate which in turn is detachably held on the ski with the retraction device fully extended. The retraction device is hereby preferably arranged in the intermediate plate.

Advantageously the retraction device is detached from the ski boot, release plate or intermediate plate in the case of full extension.

If the retraction device has an extendible cable, according to the invention, one of the cable ends is preferably detachably inserted in its mounting in the case of full extension. Thus, with full extension the cable is free from its drum so that the complete separation desired by the invention is in this case achieved in very simple manner.

With ski bindings where a cable drum spring-prestressed in the winding-on direction is provided on the release plate or ski, the invention provides for the drum-side cable end to be terminated by a swivel which is radially inserted in a suitable recess. When in the case of full extension, tension on the cable no longer acts in the peripheral direction but has a substantially radial component, the swivel is released from its recess and the cable end becomes free.

It is particularly advantageous if the retraction device is locked in the released state and is only freed for retraction after eliminating this state. As a result the retraction device which has been freed from tension cannot pull itself in and be extended again by the skier prior to reinsertion of the cable.

Generally a hand lever is provided in order to accommodate release for retraction after reinserting the cable. According to a further embodiment of the invention, to prevent the release for retraction at an inopportune movement, i.e. with the cable end not refitted, the cable drum cooperates with a spring-loaded latch which snaps in when the cable is fully extended and prevents the drum from reversing, whereby appropriately a locking device is provided for the latch which only frees the latch for manual release when the cable end has been refitted in the drum.

According to a further embodiment, a spring-loaded member is arranged in a longitudinal groove provided in a release plate, intermediate plate, ski or boot sole which, via a latch can enter into tension-transmitting engagement with a swivel fixed to one end of the cable but which separates from the swivel when the cable is fully extended. Here again, an automatic locking device is advantageously provided which prevents a snapping back of the slide member after removing the cable.

In the last-mentioned embodiment the slide member can operate a lever for releasing a ski brake in the case of full extension.

According to the invention, a further generally usable embodiment of a safety ski binding in which a cable drum is used in characterised in that the drum has a diameter which varies in the axial direction in such a way that the winding diameter increases in such a way with increasing winding-off that the increasing tension of the restoring spring is compensated or over-compensated. As a result, the retraction force on extension can not only be kept constant but in fact can also ensure that the retraction force desirably tends to decrease with increasing extension.

The invention is described in exemplified manner relative to the drawings, wherein.

DETAILED DESCRIPTION OF THE DRAWINGS

Figure 1:
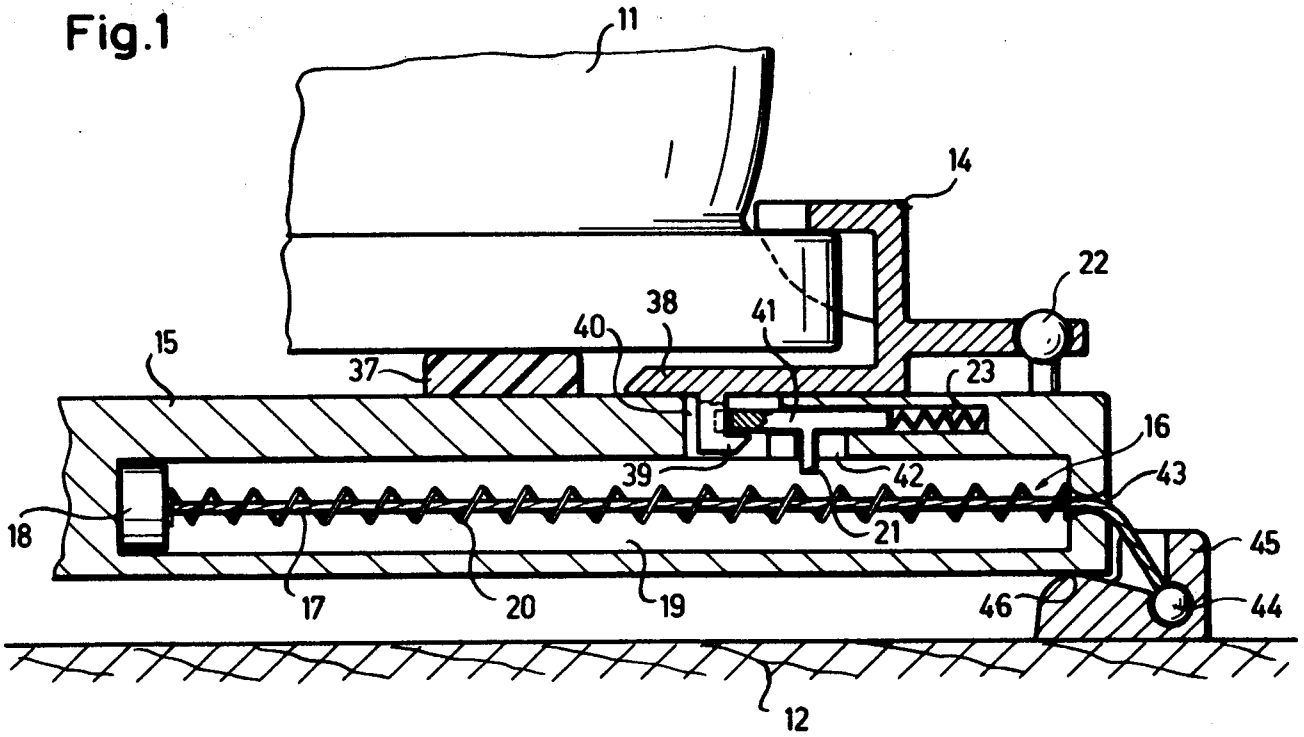
FIG. 1 is a partial schematic vertical longitudinal sectional view of a first embodiment of a safety ski binding according to the invention.

According to FIG. 1, the sole of a ski boot 11 is held by a sole holding-down device 14 on a fixed or sliding plate 37 fixed to a sole plate. The holding-down device 14 has a tread member 38, to the bottom of which is fixed a hook 39 which enters an opening 40 in sole plate 15. A slide 41 cooperates with hook 39, said slide being pretensioned by a compression spring 23 in the direction of the engagement with hook 39.

A shoulder 21 extends from slide 41 through a further opening 42 downwards and into a longitudinal groove 19. In the longitudinal groove 19 which extends over a considerable portion of the length of sole plate 15 is provided an axially displaceable plunger 18, from which extends a cable 17 to a passage opening 43 at the end of sole plate 15, where it passes to the outside and into an end piece 44 which is secured in a support member 45 on ski 12.

A compression spring 20 is placed around the cable 17 in the vicinity of longitudinal groove 19 and serves to pretension the plunger 18 in its left-hand terminal position shown in FIG. 1. As a result, sole plate 15 is forced against a support 46 on support member 45.

In the case of an excessive upward or lateral force on sole plate 15 accompained by the movement of said sole plate plunger 18 moves to the right and spring 20 is compressed relative to sole plate 15. In the case of a normal fall or when skiing over ridges, plunger 18 does not reach shoulder 21 and sole plate 15 returns to the normal position shown in FIG. 1 after the force has collapsed.

If, however, the sole plate 15 is moved from the ski 12 to such an extent that plunger 18 reaches shoulder 21, the slide 41 is moved to the right and frees hook 39 and therefore holding-down device 14. The latter can now pivot about the transverse axis 22 in an upwards direction. However, 22 can also be a ball joint, slide 41 securing holding-down device 14 not only in the vertical direction but also in the lateral direction. In this case, the pulling back of slide 41 would completely free both the vertical and lateral release for ski boot 11. Preference is given to the combined vertical and lateral release.

Figure 2:
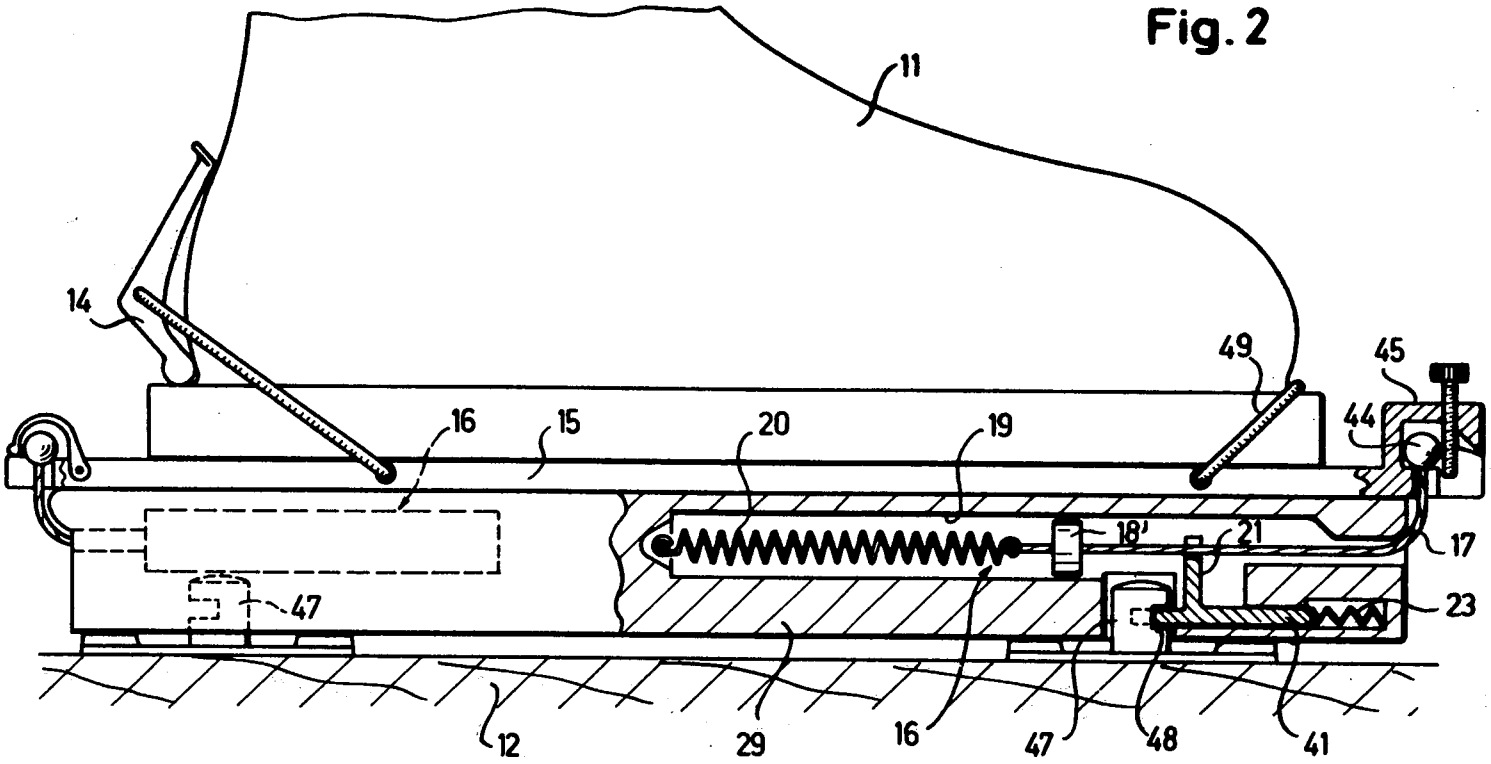
FIG. 2 is a partial schematic vertical longitudinal sectional view of a further embodiment with an intermediate plate.

FIG. 2 shows an arrangement with an intermediate plate 29 located between the sole plate 15 and the ski 12. In this embodiment the retraction device 16 is arranged in the intermediate plate, whereby in actual fact retraction devices are provided at either end of the boot. The drawing shows in detail only the retraction device at the front end of the boot and which here again has a longitudinal groove 19 and a prestressed spring 20, in this case a tension spring. The right-hand end of spring 20 in FIG. 2 engages cable 17 which by means of an end piece 44 is detachably held in a support member 45 on sole plate 15. The heel arrangement is identical.

The sole plate 15 is drawn firmly against the intermediate plate 29 by springs 20. In the case of excessive release forces the sole plate 15 is released from intermediate plate 29, accompanied by the extension of cables 17.

The intermediate plate is mounted on pins 47 fixed to the ski in such a way that a slide 41, which is under the action of a spring 23, is pressed into a slot 48 in pins 47. The construction of slide 41 is again such that the intermediate plate 29 is secured to the ski 12 in all directions. A shoulder 21 extends upwards from the slide 41 and cooperates with a movable shoulder stock 18' fixed to the cable 17.

As can be seen from the drawing, when the cable 17 is sufficiently extended the movable shoulder stock 18' displaces the shoulder 21 to the right (or to the left on the heel) so that the connection between intermediate plate 29 and pins 47 is broken.

The ski boot 11 is fixed to the sole plate 15 by conventional means 14,49.

Figure 3:
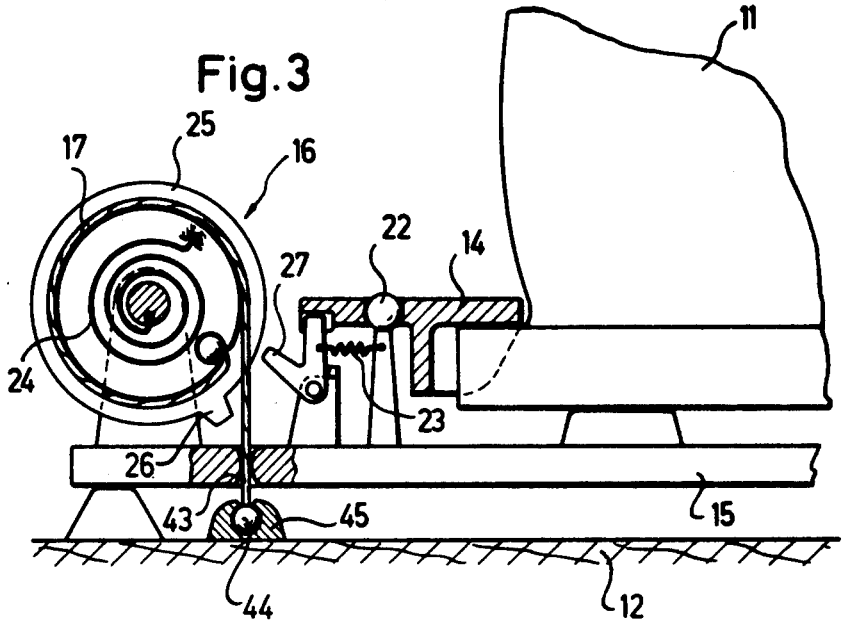
FIG. 3 is a partial schematic vertical longitudinal sectional view of a third embodiment of the safety ski binding according to the invention.

In the embodiment according to FIG. 3 the retraction device 16 comprises a cable drum fixed to the sole plate 15 and whose cable passes through a vertical bore 43 in sole plate 15 to a support member 45 fixed to the ski in which is secured the end piece 44 of cable 17. By means of a coil spring 24, cable drum 25 is so prestressed in the winding-on direction that sole plate 15 is securely held to the ski 12 until a predetermined release force occurs.

In this and other embodiments, the housing conventionally used with such bindings has been omitted for ease of reference.

On its periphery, cable drum 25 has a radially projecting member 26 which cooperates with a locking lever 27 mounted in rotary manner on sole plate 15. Locking lever 27 has, in addition to the arm cooperating with shoulder 26, a further vertical arm which engages beneath a portion of the holding-down device 14 which projects over the ball joint 22 in such a way that the holding-down device 14 is locked in both the vertical and lateral directions, i.e., correspondingly secures ski boot 11.

On exceeding the predetermined release force, the sole plate 15 is released from the ski 12 accompanied by the pulling out of cable 17 or the uncoiling thereof from cable drum 25. When fully extended, the radially projecting member 26 strikes against the locking lever 27 and disengages the vertical arm from holding-down device 14 so that the latter can be pivoted both upwards and sidewards in powerless manner, thereby freeing the boot 11. In normal circumstances, spring 23 ensures a secure engagement of locking lever 27 and holding-down device 14.

Figure 4:
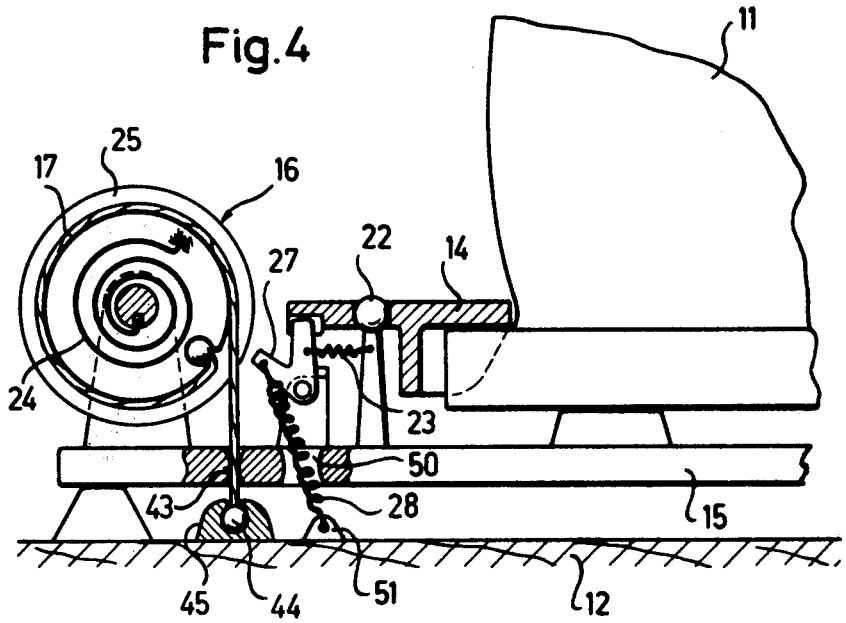
FIG. 4 is a sectional view analogous to FIG. 3, of a modified embodiment.

FIG. 4 shows a similar arrangement, whereby in place of the radial projection 26 and cable drum 25 a helically wound unlocking cable 28 is fixed to locking lever 27, and passes through a further opening 50 in sole plate 15, being fixed via its other end to a ring 51 fixed to the ski.

When in the case of a release the cable 17 uncoils from drum 25, unlocking cable 28 can extend with the use of minimum forces. In the case of a complete extension of cable 17, unlocking cable 28 is stretched, whereby locking lever 27 is pivoted in counter-clockwise direction in FIG. 4, thereby completely freeing the holding-down device 14 in the vertical and lateral directions. Subsequently, due to the action of spring 24, cable drum 25 draws sole plate 15 onto the ski 12 again, whereby the unlocking cable 28 is shortened to the length shown in the drawing.

Figure 5:
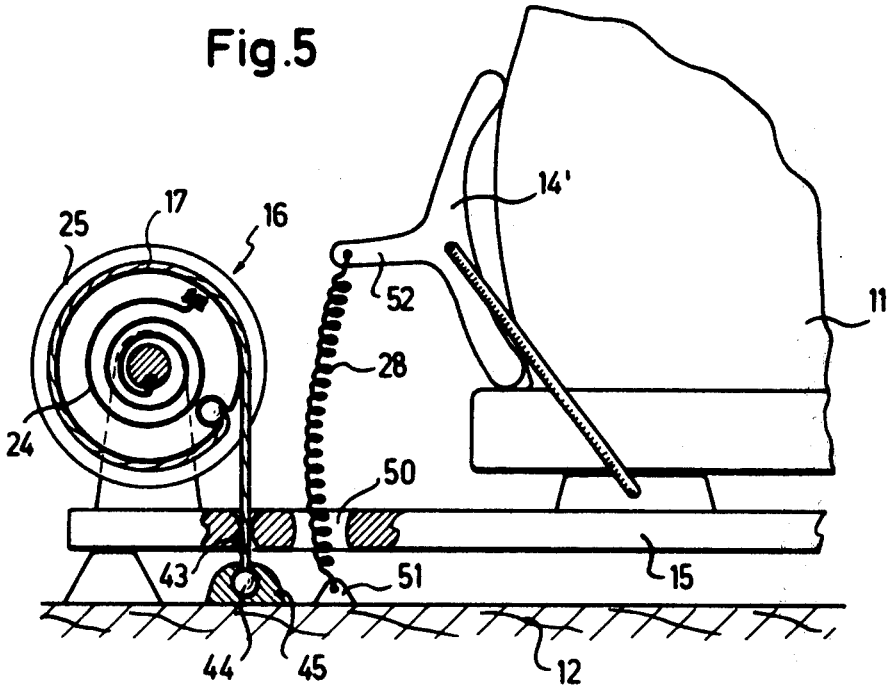
FIG. 5 is a sectional view analogous to FIG. 3, of a further modified embodiment.

A further possibility for bringing about the action of unlocking cable 28 is shown in FIG. 5. In this case the unlocking cable is fixed to a rearwardly extending extension 52 of a known toggle-joint holding-down device 14' so that with the cable 17 fully extended and unlocking cable 28 stretched, the toggle-joint receives an opening moment and releases the ski boot 11. The extension 52 of toggle-joint holding-down device 14' can also be operated by a shoulder such as 26 in FIG. 3.

Figure 6:
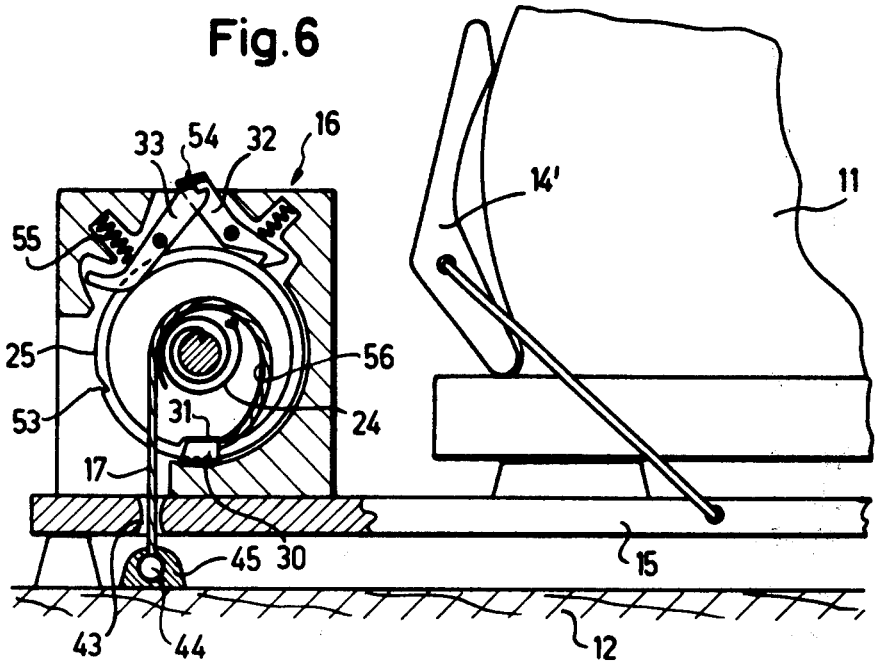
FIG. 6 is a sectional view analogous to FIG. 3, of a further modified embodiment.

FIG. 6 shows an embodiment in which the ski boot 11 is also fixed to the sole plate 15 by means of a toggle-joint holding-down device 14'. The construction of the retraction device 16 is substantially analogous to that of FIGS. 3 to 5 with the exception that the drum-side end of the cable 17 has a swivel 30 which engages in radially detachable manner in a recess 31 of cable drum 25. When cable 17 is fully extended, the swivel 30 receives an increasingly radially acting force component which finally leads to the swivel 30 being completely removed from recess 31. The sole plate 15 is now completely separated from the ski 12.

To prevent a reversal of the drum 25 after separating swivel 30 therefrom, a latch 32 is provided on the outer periphery which cooperates with a locking recess 53 of cable drum 25 in such a way that after removal of swivel 30 a reversal of drum 25 is prevented. A re-release of cable drum 25 after inserting swivel 30 in recess 31 can be brought about by a pressure on the key 54 of latch 32 projecting upwards from the housing.

However, to prevent the key 54 being pressed with the swivel 30 not inserted, a locking device 33 is provided which on the one hand engages on the latch 32 and on the other engages on the periphery of cable drum 25. Only when the swivel 30 is inserted does the locking device 33 move counter to the tension of a spring 55 to such a position that the latch 32 is freed for starting the retraction movement.

FIG. 6 shows a further feature in which the cable drum 25 has a spiral winding surface 56. Through increasing the diameter on increased winding of cable 17 from drum 25, the generally increasing restoring force of restoring spring 24 can be compensated or if desired also over-compensated.

In the case that there are several cable turns on the drum, the decreasing extension force can also be brought about by axially increasing the drum diameter.

Figure 7:
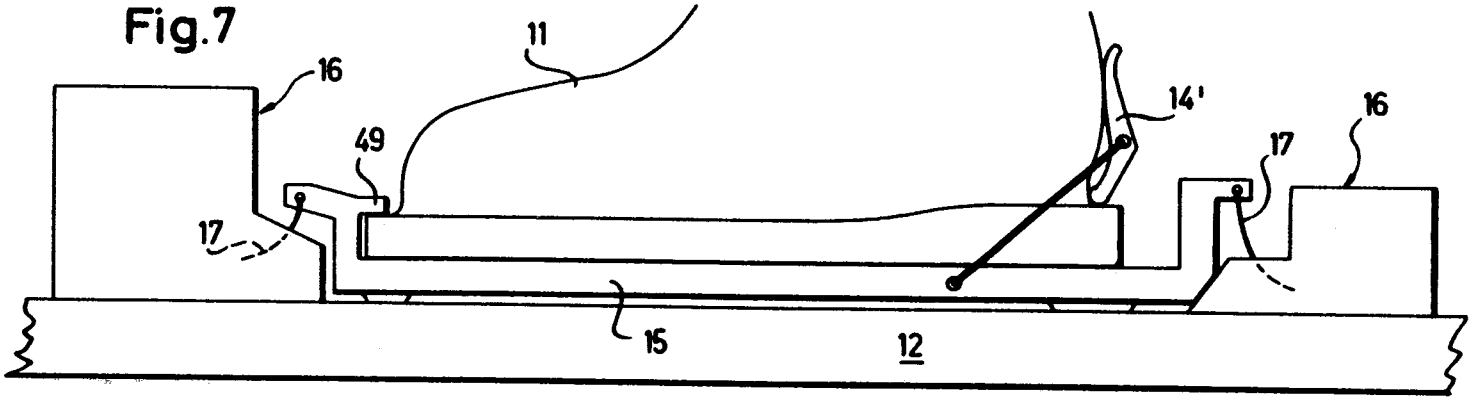
FIG. 7 is a schematic side view of a further embodiment of the safety ski binding according to the invention.

FIG. 7 shows an arrangement in which the retraction devices 16 equipped with cable drums 25 are fixed to the ski 12 instead of to the sole plate 15. In analogous manner the ends of cable 17 are fixed to sole plate 15.

Figure 8:
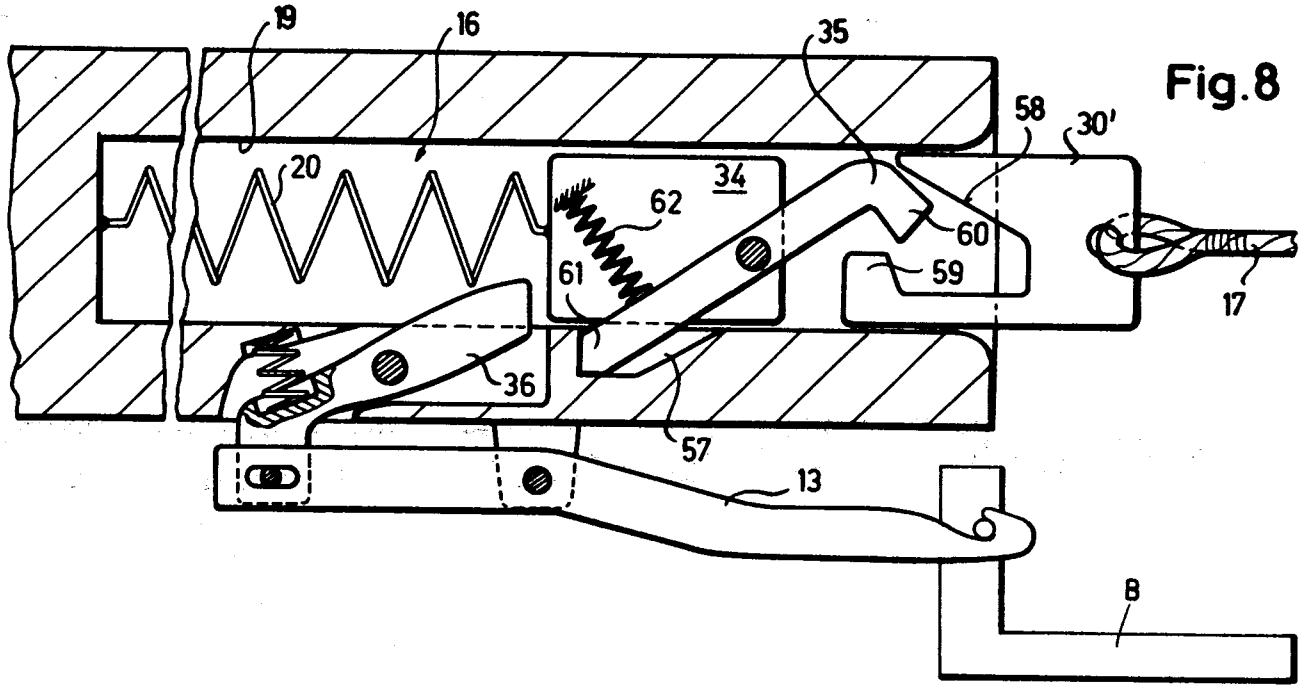
FIG. 8 is an enlarged sectional view of a preferred linearly functioning retraction device for the safety ski binding according to the invention.

FIG. 8 shows a particularly advantageous embodiment of a linearly working retraction device 16 where a slide member 34 is axially displaceably arranged in a longitudinal groove 19 of suitable length, whereby the member 34 is pretensioned by a spring 20, to the left in FIG. 8. By means of the latch 35 having the configuration shown in FIG. 8, the slide member 34 cooperates with a recess 57 in the wall of groove 19 and a swivel 30' which is fixed to the end of cable 17. In the direction of groove 19, the swivel 30 has a jaw-shaped configuration with an upper inclined edge 58 and a lower hook 59, and the latch 35 has a counterpiece 60 to the inclined surface 58 and the hook 59. The members are dimensioned and shaped in such a way that on inserting the swivel 30', accompanied by the clockwise rotation of latch 35, member 60 slides from inclined surface 58 whereby the hook portion of end 60 engages behind hook 59. During this movement, the other end 61 of latch 35 is lifted from the associated recess 57 so that (apart from the action of lever 36) spring 20 can draw swivel 30' into the longitudinal groove 19. Lever 36 serves as an additional locking member which can be operated by hand and serves to prevent the cable 17 from being suddenly drawn into groove 19 after inserting swivel 30'. This is only in fact intended to take place after a further process, namely the raising of lever 36 by the skier.

Release takes place in the opposite sequence in the following manner:

On removing slide member 34 by means of cable 17, the latter firstly overtravels lever 36 so that the latter is rotated clockwise, thereby operating the lever 13 connected to the ski brake B. Due to the action of compression spring 62, latch 35 with its end 61 can only snap into recess 57 slightly later whereby swivel 30' is released and can be withdrawn freely at the front. Through the engagement of end 61 in recess 57 and lever 36, double-locking against the retraction of slide member 34 exists.

Figure 9:
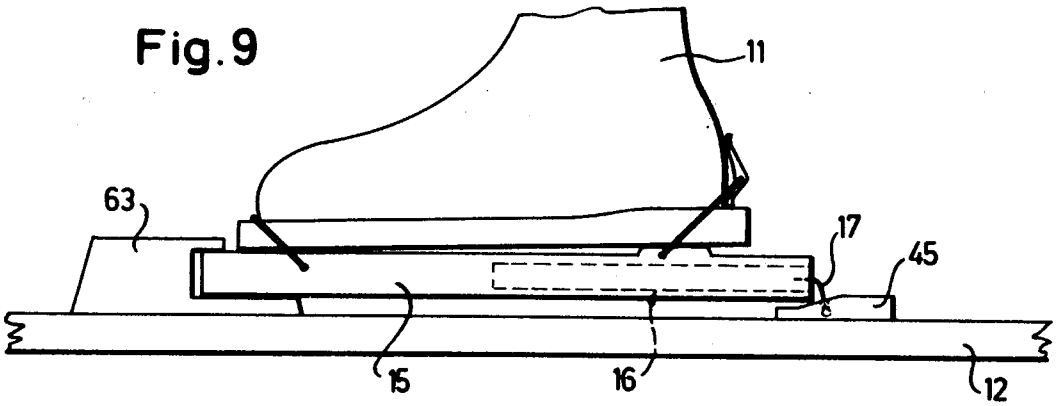
FIG. 9 is a schematic side view of a further embodiment of a safety ski binding according to the invention.
Figure 10:
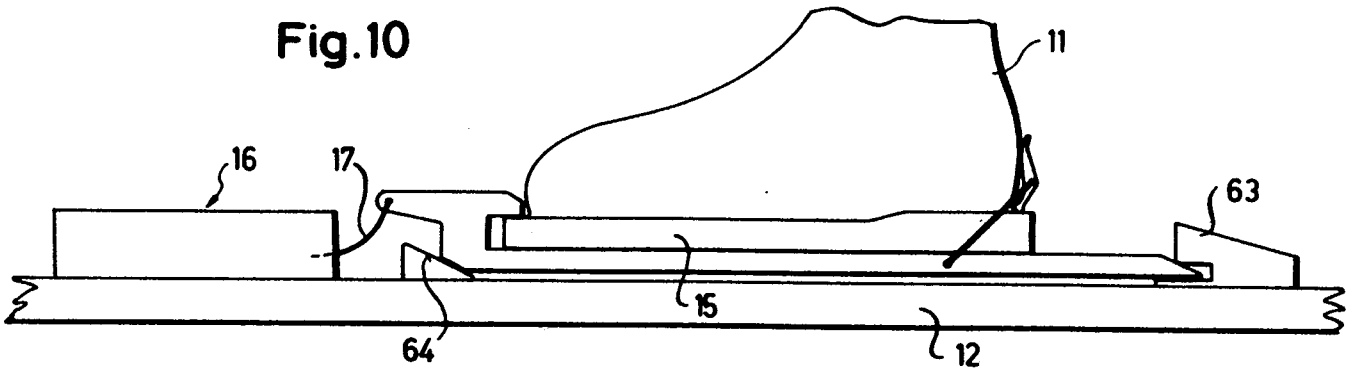
FIG. 10 is a view analogous to FIG. 9 of a modified embodiment.

FIGS. 9 and 10 show two possibilities for the arrangement of the retraction device 16 according to FIG. 8 in the case of a plate binding. The retraction device 16 can either be fixed in the sole plate 15 or directly to the ski 12.

It is generally sufficient if the retraction device according to the invention is only arranged on one end of the ski boot, whilst at the other end a conventional binding 63 is provided. However, it is also possible, and in certain cases advantageous, if such retraction devices are provided at both ends as for example in the case of the embodiment of FIG. 7.

The conventional binding 63 of FIG. 10 can also have an inclined surface which cooperates with an identical inclined surface 64 on the opposite binding in such a way that the retraction device is also responsible for the securing and release on the conventional binding portion.

Within the meaning of the present description, the term holding-down device means a sole holding-down device which not only secures the boot in the downwards direction, but also in the lateral direction.

We claim:

1. A safety ski binding comprising:

extensible line means for interconnecting a ski boot and a ski, restoring force means acting on said extensible line means to force said extensible line means toward a position holding the ski boot in an in-use position on the ski while permitting relative movement of the boot and ski caused by skiing forces, accompanied by extension of the extensible line means which remains connected between the boot and ski to assure return of the boot to its in use skiing position upon cessation of the skiing forces, and disconnecting means for automatically disconnecting the extensible line means from one of the ski boot and ski to separate the ski and ski boot in response to extension of the extensible line means beyond a predetermined maximum amount.

2. A safety ski binding according to claim 1, further comprising:

ski brake means movable between non-braking and braking positions, ski brake holding means for holding said ski brake means in said non-braking position when said extensible line means interconnects said ski boot and ski, and ski brake activating means for moving said ski brake means to said braking position in response to disconnection of said extensible line means by said disconnecting means.

3. A safety ski binding according to claim 2, wherein the disconnecting means includes means for simultaneously releasing the ski brake when disconnecting the extensible line means.

4. A safety ski binding according to claim 3, wherein a slide member operates a lever for releasing the ski brake in the case of complete extension of the extensible line means.

5. A safety ski binding according to claim 3, wherein the extensible line means includes an extensible cable, and wherein the releasing means releases the ski brake in response to full extension of said cable.

6. A safety ski binding according to claim 1, comprising a sole plate, boot hold-down means for holding the boot on the sole plate, and sole plate hold-down means for holding the sole plate on the ski, wherein said extensible line means connects the sole plate to the ski, and wherein said disconnecting means includes releasing means for releasing one of said boot hold-down means and said sole plate hold-down means in response to said extension of the extensible line means beyond a predetermined amount.

7. A safety ski binding according to claim 6, wherein the extensible line means includes a cable and wherein a plunger extendable by the cable is arranged in a longitudinally displaceable manner in a longitudinal groove of the plate, said plunger being prestressed by a spring in any normal position in which the plate is held on the ski, said plunger simultaneously forming the releasing means.

8. A safety ski binding according to claim 7, wherein, in the vicinity of the end of the longitudinal groove, the boot hold-down means includes a movable shoulder prestressed in the holding direction by a spring which projects into the groove to be engaged by the plunger.

9. A safety ski binding according to claim 8, wherein the boot hold-down means is arranged on the sole plate and is detachably held down by said shoulder, and wherein said boot hold-down means pivots about a transverse axis and optionally about a vertical axis.

10. A safety ski binding according to claim 6, wherein the extensible line means includes a cable drum fixed to the sole plate which is prestressed in the winding-on direction by a spring, wherein the cable of the cable drum is fixed to the ski, and wherein the releasing means releases said boot hold-down means when the cable is fully extended.

11. A safety ski binding according to claim 10, wherein a projection is provided on the cable drum which, when the cable is fully extended, operates a locking lever prestressed in the locking direction and which releases the boot hold-down means.

12. A safety ski binding according to claim 11, wherein the boot hold-down means is constructed as a holding device whereon engages the locking lever and which pivots about a transverse axis and preferably about a vertical axis.

13. A safety ski binding according to claim 10, wherein a locking lever which when operated releases the boot hold-down means is provided and which is connected with the ski via an extensible unlocking member in such a way that when the cable is fully extended, the unlocking member is stretched and throws the locking lever into its release position.

14. A safety ski binding according to claim 13, wherein the unlocking member is a helically wound grappling cable.

15. A safety ski binding according to claim 10, wherein the boot hold-down means includes a toggle-joint holding down device connected to an extensible unlocking member, and wherein the other end of the unlocking member is fixed to the ski in such a way that with the cable fully extended the unlocking member is stretched and the toggle-joint holding-down device is opened.

16. A safety ski binding according to claim 10, wherein the drum has a variable diameter in such a way that the winding diameter increases with increasing winding-off, in such a way that the increasing force of the restoring spring is compensated or over-compensated.

17. A safety ski binding according to claim 16, wherein the drum has a spiral shape.

18. A safety ski binding according to claim 16, wherein the boot hold-down means includes a toggle-joint holding down device connected to an extensible unlocking member, and wherein the other end of the unlocking member is fixed to the ski in such a way that with the cable fully extended the unlocking member is stretched and the toggle-joint holding-down device is opened.

19. A safety ski binding according to claim 6, wherein the releasing means releases the sole plate hold-down means in response to said extension of the extensible line means beyond a predetermined amount.

20. A safety ski binding according to claim 19, wherein the sole plate is connected with an intermediate plate by said extensible line means, which intermediate plate is in turn detachably held on the ski, said releasing means releasing said intermediate plate together with said sole plate in response to said extension of the extensible line means beyond a predetermined amount.

21. A safety ski binding according to claim 20, wherein the restoring force means is arranged in the intermediate plate.

22. A safety ski binding according to claim 6, in which the extensible line means includes an extendable cable, wherein said releasing means disconnects one of the cable ends from its mounting in the case of full extension of said cable.

23. A safety ski binding according to claim 22, wherein a slide member spring-loaded by a spring is arranged in a longitudinal groove provided in one of the sole plate, an intermediate plate disposed between the sole plate and the ski, the ski, and the ski boot, whereby said slide member can enter into a tension-transmitting engagement via a latch with a swivel fixed to the end of the cable, but is separated from the swivel in the case of complete cable extension.

24. A safety ski binding according to claim 22, wherein the extensible line means and restoring force means are automatically locked in the released state upon said automatic disconnection and only after eliminating this state are they again freed for retraction.

25. A safety ski binding according to claim 6, in which said extensible line means includes a cable drum spring-pretensioned in the winding-on direction and arranged on one of the sole plate and the ski, wherein the drum side cable end is terminated by a swivel which is radially inserted in a fitting recess.

26. A safety ski binding according to claim 25, wherein the cable drum cooperates with a spring-loaded latch which snaps in when the cable is fully extended and secures the cable drum against reversing.

27. A safety ski binding according to claim 26, wherein a locking device is provided for the latch which only frees the latch for manual release when the cable end has again been fitted in the drum.

28. A safety ski binding according to claim 25, wherein the extensible line means and restoring force means are automatically locked in the released state upon said automatic disconnection and only after eliminating this state are they again freed for retraction.

29. A safety ski binding according to claim 28, wherein the cable drum cooperates with a spring-loaded latch which snaps in when the cable is fully extended and secures the cable drum against reversing.

30. A safety ski binding according to claim 25, wherein the drum has a variable diameter in such a way that the winding diameter increases with increasing winding-off, in such a way that the increasing force of the restoring spring is compensated or over-compensated.

31. A safety ski binding according to claim 6, wherein the extensible line means and restoring means are automatically locked in the release state upon said automatic disconnection and only after eliminating this state are they again freed for retraction.

32. A safety ski binding according to claim 6, further comprising:

ski brake means movable between non-braking and braking positions, ski brake holding means for holding said ski brake means in said non-braking position whenever said extensible line means interconnects said ski boot and ski, and ski brake activating means for moving said ski brake means to said braking position in response to disconnection of said extensible line means by said disconnecting means.

33. A safety ski binding according to claim 32, wherein said releasing means releases the sole plate hold-down means in response to said extension of the extensible line means beyond a predetermined amount.

* * * * *